US010779604B2

(12) United States Patent
Lebel et al.

(10) Patent No.: US 10,779,604 B2
(45) Date of Patent: Sep. 22, 2020

(54) EARPHONE AND HELMET WITH EARPHONE

(71) Applicant: Galvion Ltd., Portsmouth, NH (US)

(72) Inventors: Stéphane Lebel, St. Redempteur (CA); Dominic Giroux Bernier, St-Gabirel de Brandon (CA); Celine Gagnon, St-Jerome (CA); Maryanne MacDougall, Lachine (CA); Richard Coomber, Beaconsfield (CA)

(73) Assignee: Galvion Ltd., Portsmouth, NH (US)

( * ) Notice: Subject to any disclaimer, the term of this patent is extended or adjusted under 35 U.S.C. 154(b) by 0 days.

(21) Appl. No.: 14/955,023

(22) Filed: Nov. 30, 2015

(65) Prior Publication Data

US 2017/0150769 A1 Jun. 1, 2017

(51) Int. Cl.

| | |
|---|---|
| ***A42B 3/30*** | (2006.01) |
| ***A42B 3/16*** | (2006.01) |
| ***H04R 1/10*** | (2006.01) |

(52) U.S. Cl.

CPC ..... *A42B 3/30* (2013.01); *A42B 3/16* (2013.01); *H04R 1/1066* (2013.01)

(58) Field of Classification Search

CPC .. A42B 3/30; A42B 3/16; A42B 3/303; A42B 3/306; H04R 1/1066

USPC ..... 2/422

See application file for complete search history.

(56) References Cited

U.S. PATENT DOCUMENTS 3,586,977 A * 6/1971 Lustig ..... A42B 3/30 2/410
3,864,756 A * 2/1975 Desimone ..... A42B 3/166 2/209
3,906,547 A * 9/1975 Aileo ..... A42B 3/16 2/422
3,916,312 A * 10/1975 Campbell ..... A42B 3/30 2/422
4,109,105 A * 8/1978 Von Statten, Jr. ..... A42B 3/30 2/422
5,465,421 A 11/1995 McCormick et al.
5,615,410 A * 3/1997 DeMars ..... A42B 3/303 455/128
6,352,383 B1 * 3/2002 Ristola ..... A42B 3/04 2/10
6,546,264 B1 * 4/2003 Kennedy ..... A42B 3/30 379/430
6,754,911 B1 * 6/2004 Howell ..... A42B 3/166 2/209
6,978,034 B2 * 12/2005 Lazzeroni ..... A42B 3/30 379/430
8,028,344 B2 * 10/2011 Rogers ..... A42B 3/166 2/422
8,600,094 B2 * 12/2013 Kushnirov ..... H04R 1/028 379/430

(Continued)

FOREIGN PATENT DOCUMENTS

WO WO 9725832 A1 * 7/1997 ..... A42B 3/30
WO WO 2015108854 A1 * 7/2015 ..... A42B 3/30

*Primary Examiner* — Alissa L Hoey

(74) *Attorney, Agent, or Firm* — Wolf, Greenfield & Sacks, P.C.

(57) ABSTRACT

Earphones which attach to an interior of a helmet are disclosed. Physical attachment of the earphones to the helmet result in an electrical connection in some embodiments. The headphones may be used without the helmet through the use of strap holder adapters in some embodiments.

14 Claims, 11 Drawing Sheets

(56) References Cited

U.S. PATENT DOCUMENTS 8,667,617 B2 * 3/2014 Glezerman ..... A42B 3/30 2/410
8,688,040 B2 * 4/2014 Jung ..... A42B 3/30 455/41.2
8,994,610 B2 * 3/2015 Tricoukes ..... H04R 1/105 345/8
9,042,944 B2 5/2015 Dieringer
9,101,175 B2 * 8/2015 Redpath ..... A42B 3/04
9,439,467 B2 * 9/2016 Stiff ..... A42B 3/04
9,486,027 B2 * 11/2016 Dey ..... A42B 3/046
2002/0131616 A1 * 9/2002 Bronnikov ..... A42B 1/245 381/370
2004/0226079 A1 * 11/2004 Rainey ..... A42B 3/30 2/422
2006/0034477 A1 * 2/2006 Lazzeroni ..... A42B 3/30 381/376
2006/0057972 A1 * 3/2006 Wikel ..... A42B 3/30 455/90.3
2008/0056525 A1 * 3/2008 Fujiwara ..... H04R 1/1033 381/374
2008/0141429 A1 6/2008 Scharpenack et al.
2009/0126059 A1 * 5/2009 Tack ..... A42B 3/04 2/2.5
2009/0307826 A1 * 12/2009 Rogers ..... A42B 3/04 2/422
2011/0034217 A1 * 2/2011 Kushnirov ..... H04R 1/08 455/569.1
2011/0170702 A1 * 7/2011 Bays ..... H04R 5/0335 381/74
2011/0314594 A1 * 12/2011 Rogers ..... A42B 3/04 2/421
2012/0077438 A1 3/2012 Jung
2012/0148080 A1 6/2012 Kushnirov et al.
2012/0189153 A1 7/2012 Kushnirov et al.
2013/0086722 A1 * 4/2013 Teetzel ..... F41H 1/04 2/2.5
2013/0185905 A1 * 7/2013 Stiff ..... A42B 3/04 24/572.1
2014/0000013 A1 * 1/2014 Redpath ..... A42B 3/04 2/422
2014/0000014 A1 * 1/2014 Redpath ..... A42B 3/04 2/422
2014/0000015 A1 * 1/2014 Arai ..... A42B 3/30 2/422
2014/0020159 A1 * 1/2014 Teetzel ..... A42B 3/0406 2/422
2016/0100649 A1 * 4/2016 Glezerman ..... A42B 3/04 455/41.2
2017/0052000 A1 2/2017 White et al.

* cited by examiner

EARPHONE AND HELMET WITH EARPHONE

BACKGROUND

Military and law personnel, first responders, athletes, and other users wear protective headgear such as a helmet. Earphones and/or microphones may be used with a helmet to aid the helmet wearer with communication.

SUMMARY

According to one embodiment, a helmet and earphone assembly includes a helmet including a helmet connector portion positioned on an inner portion of the helmet. The assembly also includes an earphone including an earphone connector portion removably attachable to the helmet connector portion.

According to another embodiment, a helmet and earphone assembly includes a helmet including a first helmet electrical contact, and an earphone. The earphone includes a first earphone electrical contact, and the earphone is removably securable to the helmet via a connector such that translation of the earphone relative to the helmet shell is substantially prevented when the earphone is secured to the helmet via the connector. The connector, the first helmet electrical contact, and the first earphone electrical contact are arranged such that securement of the earphone to the helmet via the connector brings the first earphone support electrical contact into contact with the first helmet electrical contact.

According to a further embodiment, an earphone assembly includes first and second earphones, each having an earphone electrical contact. The assembly also includes first and second strap holders, each having a strap holder electrical contact. A strap assembly is configured to hold the earphones on a wearer's head when the strap assembly is attached to the first and second strap holders. The first earphone is removably attachable to the first strap holder, and the second earphone is removably attachable to the second strap holder. Attachment of the first earphone to the first strap holder results in contact of the electrical contact of the first earphone with the electric contact of the first strap holder. Attachment of the second earphone to the second strap holder results in contact of the electrical contact of the second earphone with the electric contact of the second strap holder.

According to another embodiment, an earphone and helmet assembly includes a helmet having an outer shell, and first and second earphones removably attached to a helmet such that the earphones are adjacently lateral to, or in contact with, a wearer's ears when the helmet is worn by the wearer and the earphones are attached to the helmet. First and second portions of the outer shell are laterally adjacent the first and second earphones, respectively, when the earphones are attached to the helmet.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Protective helmets are known in which speakers are permanently mounted on the inside of the helmet. Noise-attenuating earphones are known to be pivotally attached to the exterior of helmets so that the earphones can be placed in a use or non-use position according the wearer's needs.

Applicant has appreciated that when wearing a helmet, it can be advantageous for a wearer to be able to easily remove earphones, especially when using earphones which substantially cover the wearer's ears. In some cases, it can be helpful to be able to remove the earphones without removing the helmet. Similarly, convenient re-donning of the earphones can be helpful—in some cases while still wearing the helmet. Many conventional headphones are supported on the wearer's head by straps going over the wearer's head or behind the wearer's neck. To attach or remove the earphones with such headphones, the helmet typically has to be removed. With embodiments disclosed herein, headphones can be attached or removed to a helmet while the helmet is being worn so that the wearer does not have to remove the helmet.

To further simplify the attachment process, the helmet and earphone assembly may be arranged such that the act of physically securing the earphones to the helmet results in an electrical attachment of the earphone to the helmet in some embodiments.

According to one aspect of the present disclosure, earphones are attachable on the interior of a helmet. The earphones may be part of an earphone assembly which includes a microphone and/or other accessories. The earphone assembly may be attachable and removable by the wearer without removing the helmet in some embodiments.

When earphones are attached to the exterior of a helmet, the helmet exposes the ear of the wearer so that the earphones can reach the wearer's ears. With embodiments disclosed herein, the helmet can extend partially or entirely over the ear regions of the wearer, which provides additional ballistic or other protection for the wearer.

By providing an arrangement where the earphones are mounted to the interior of the helmet, electrical contacts can be exposed on the helmet to receive corresponding electrical contacts of the earphone assembly when the earphones are attached. The interior placement of the helmet electrical contacts limits the risk of fouling or damage from weather or other external elements.

Applicant also has appreciated that use of the same earphones as a standalone unit without the helmet may be desirable in certain situations. According to one aspect of the present disclosure, the earphones are removably attachable to a strap holder adapter, which in turn holds straps that allow wearing of the earphones without the helmet. The strap holder adapter includes a power source and/or electronic components in some embodiments.

Figure 1:
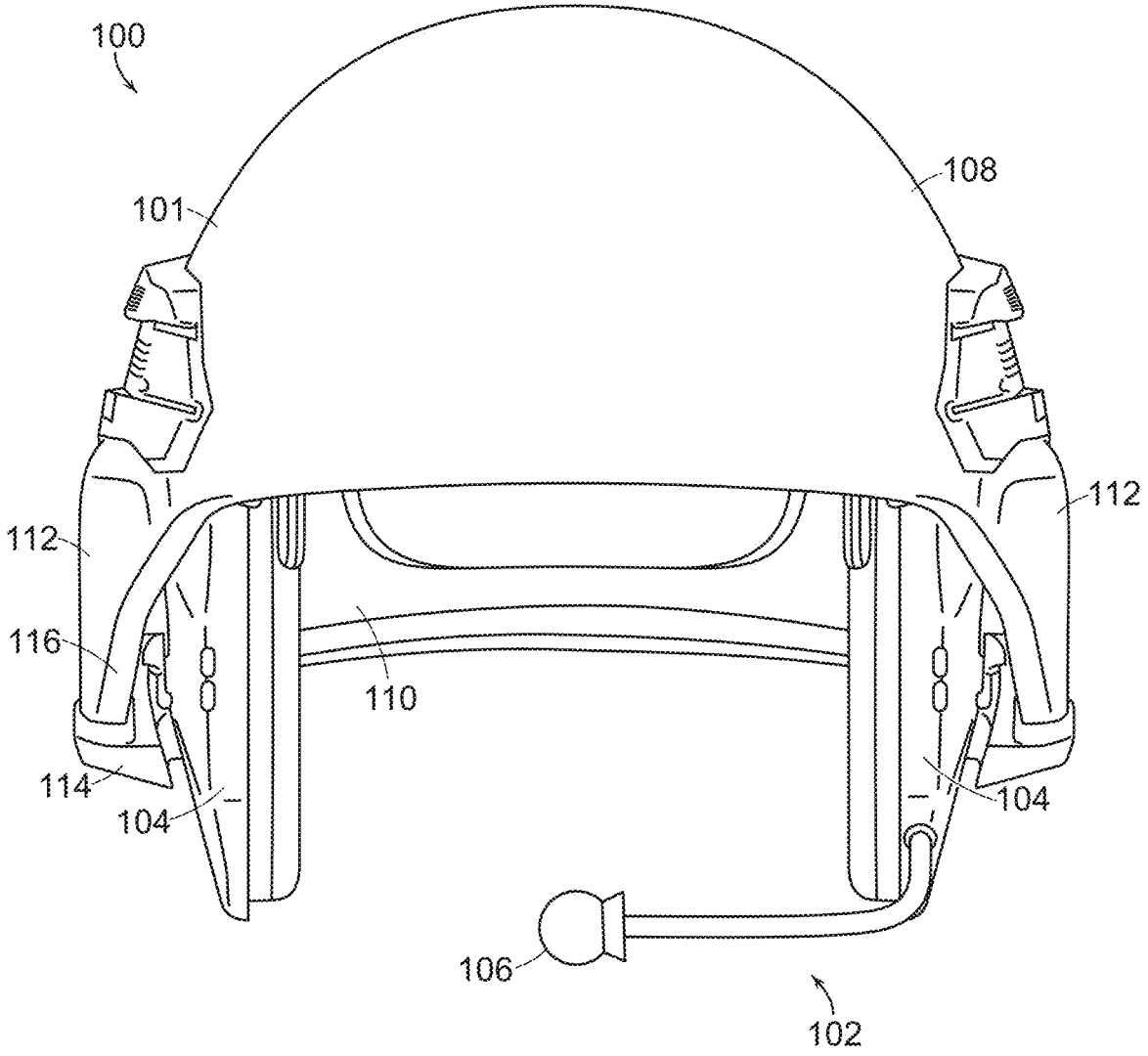
FIG. 1 is a front view of a helmet and earphone assembly according to one aspect of the invention.

FIG. 1 is a front view of a helmet assembly 100 including a helmet 101 and an attached headset assembly 102 with two earphones 104 and a microphone 106. The helmet 101 has an exterior 108 and an interior 110.

The earphones are attached to the helmet interior 110 and protrude partially below ear cover regions 112 of the helmet. In some embodiments, most, or all of the earphones may extend below a lowest portion 114 of lower rim 116 of the helmet, while in other embodiments, most, or all of the earphones may be covered by ear cover regions of the helmet.

Figure 2:
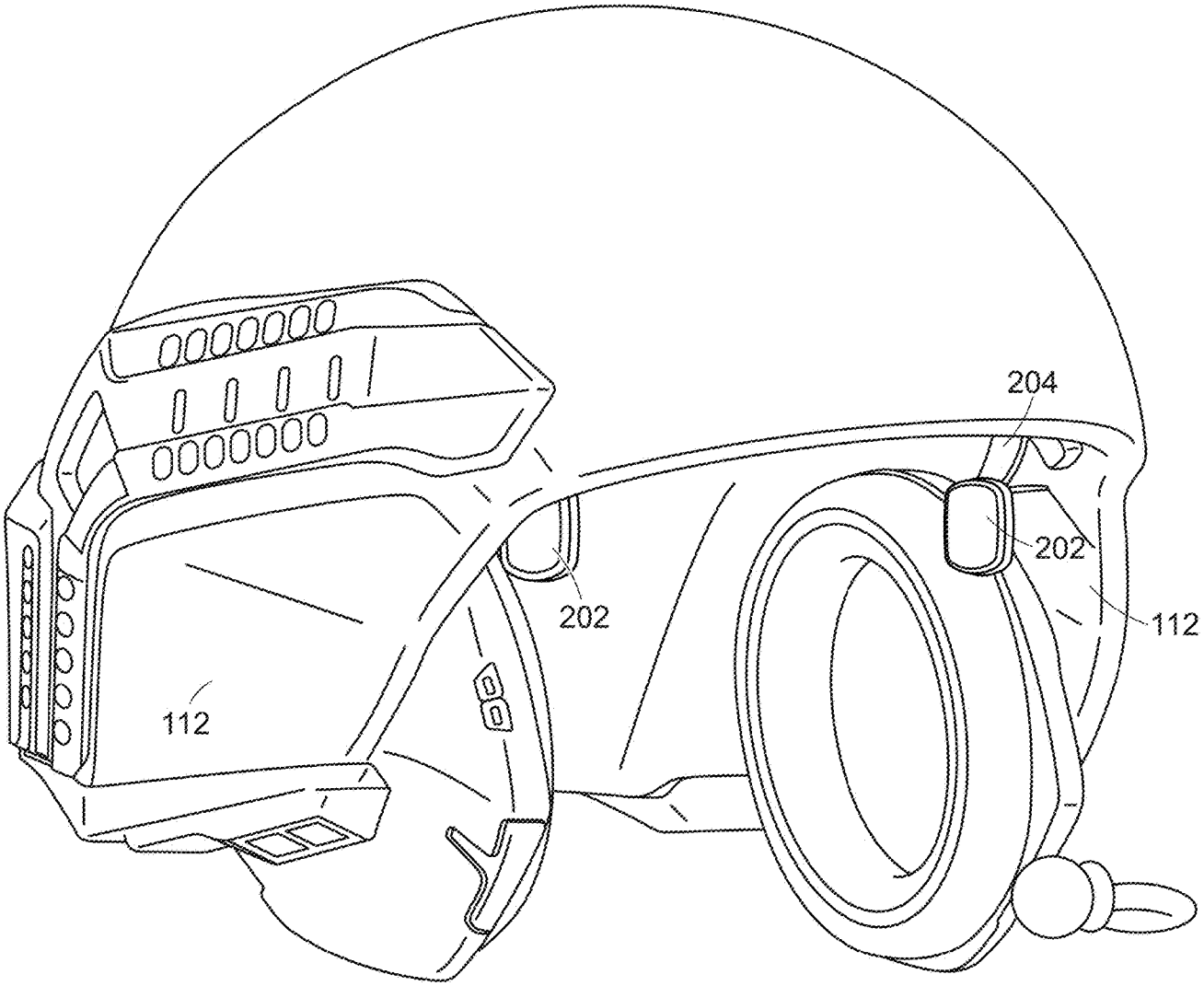
FIG. 2 is a perspective view of the helmet and earphone assembly shown in FIG. 1.

The perspective view of FIG. 2 shows the same helmet assembly 100 with biometric sensors 202 visible near the earphones. Biometric sensors 202 may be used to measure heart rate, body temperature, and/or other biometric data of the wearer. Biometric sensors are not required in all embodiments.

As shown in FIG. 2, in some embodiments of the present disclosure, more than half of the outer-facing surface of the earphones may be protected by laterally adjacent portions of the helmet shell. In this manner, the shell may provide more ballistic protection than helmet which leave the ear regions of the wearer's head exposed to permit the wearing of earphones. The helmet may cover less than all of the outer-facing surface of the earphones in some embodiments. In some embodiments, the helmet covers between 40% and 80% of the outer-facing surface of the earphones. In some embodiments, the helmet covers between 50% and 60% of the outer-facing surface of the earphones.

In the illustrated embodiment, the earphones contact the wearer as ear cushions are positioned to contact the wearer's head around the ears. In other embodiments, the earphones may be arranged to be removably attachable to be laterally adjacent the wearer's ears without contacting the wearer.

Figure 3:
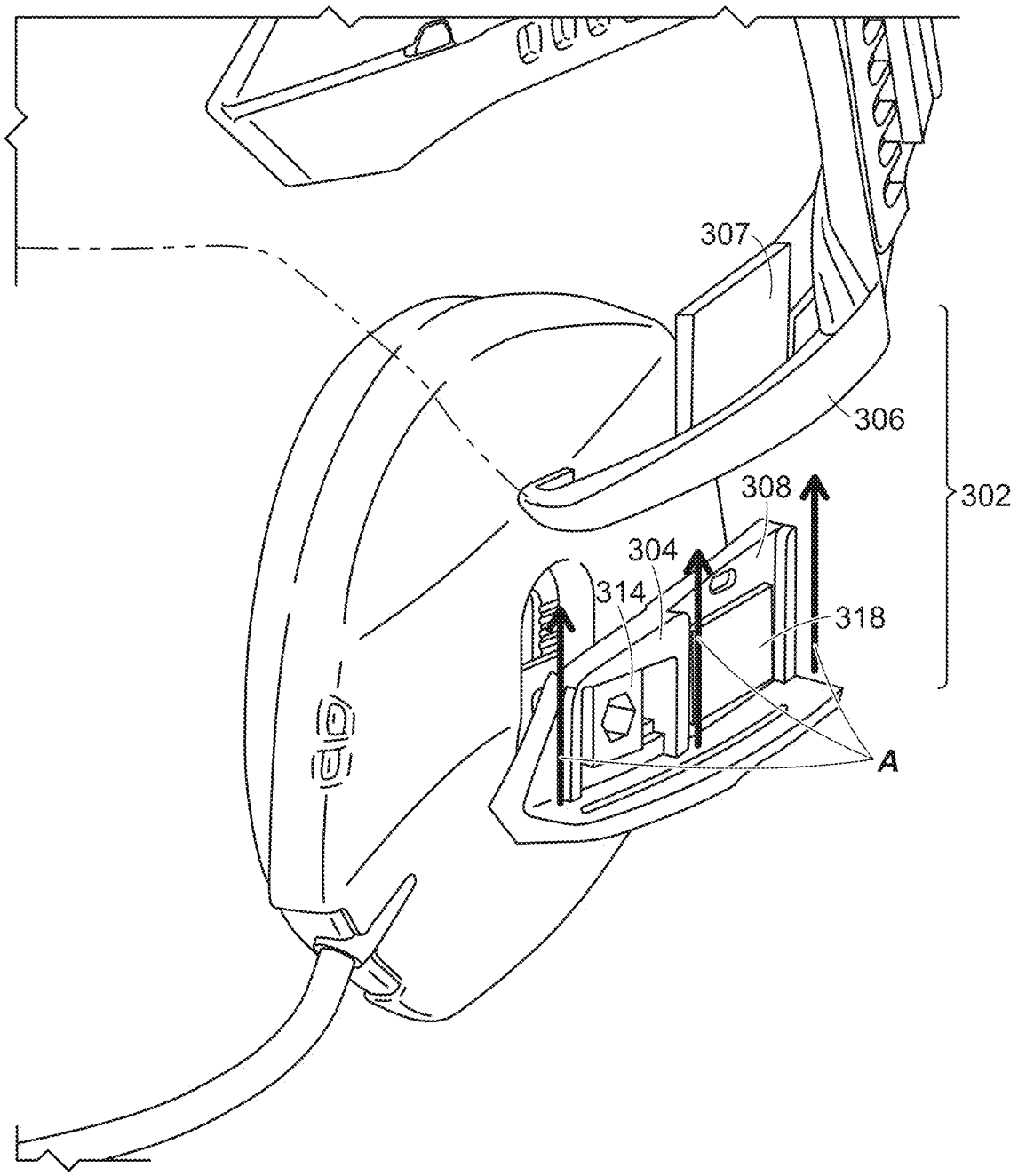
FIG. 3 is a perspective view of an earphone assembly being attached to a helmet.
Figure 6:
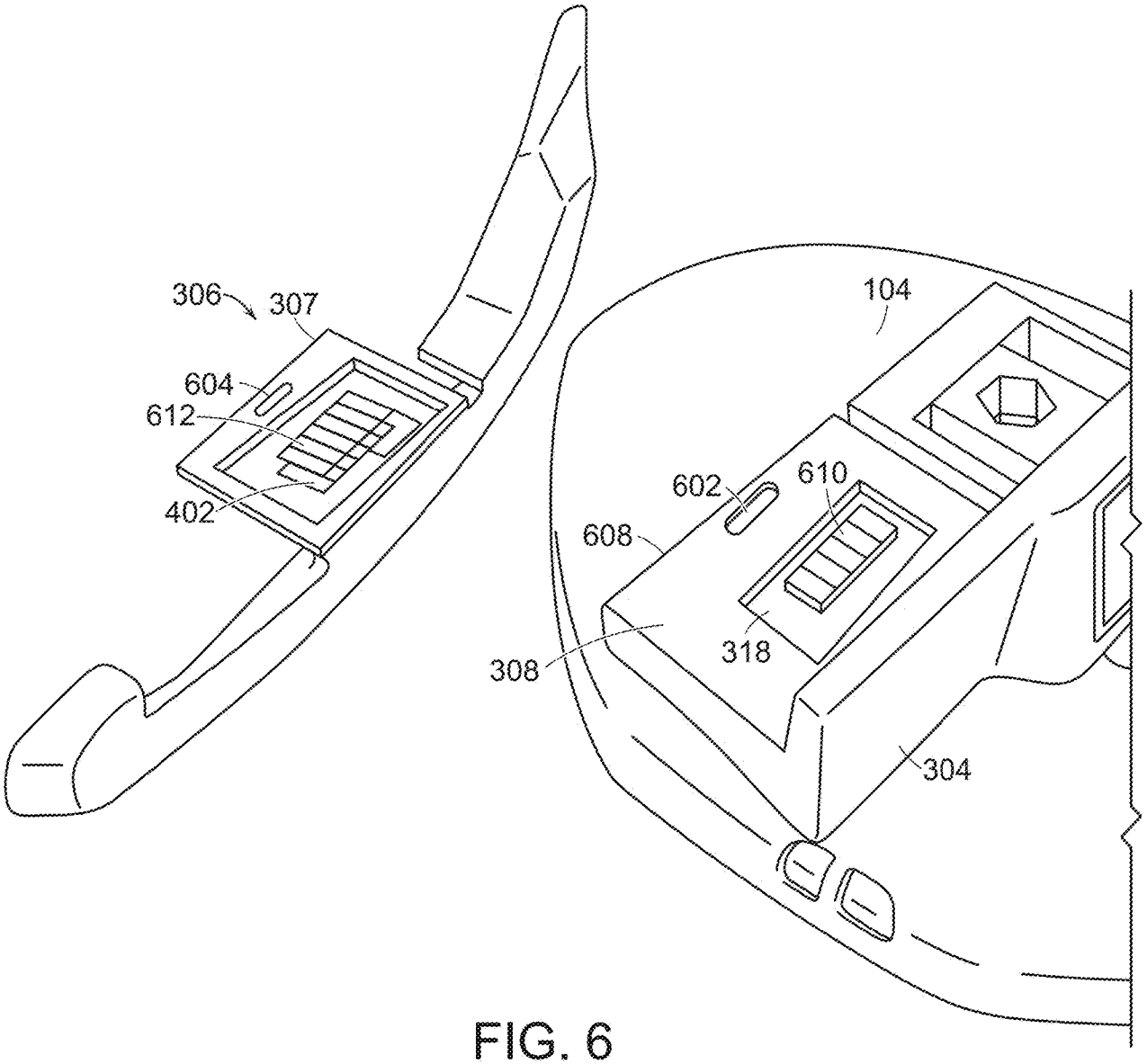
FIG. 6 shows two helmet connector portions and an earphone connector portion.

One embodiment of a connector 302 for removably securing earphone 104 is illustrated in FIG. 3. Connector 302 includes an earphone connector portion 304 and a helmet connector portion 306. Connector 302 is configured such that movement of the earphone connector portion 304 in the direction of Arrows A engages an insert 307 of the helmet connector portion with a channel 308 of the earphone connector portion. As shown in FIG. 6 and discussed further below, the connector 302 may include a cantilever snap-fit arrangement such that once the earphone connector portion reaches a certain position, a tab enters a recess and resists disconnection of the connector portions.

The snap-fit arrangement may be constructed such that the earphone is disconnectable by pulling on the earphone in a direction opposite to the direction of arrows A with at least a threshold force. In other embodiments, a pushbutton, release lever, or other actuator may require actuation before the earphone can be disconnected from the helmet.

A vertical adjustment assembly is included in the embodiment illustrated in FIG. 3. Loosening a nut 314 allows the earphone to slide vertically relative to the he earphone connector portion. Once set at a desired height, the nut may be tightened to secure the height setting. Once secured, the earphone may be attached to the helmet. This adjustment assembly is one embodiment of an adjustment lock. Nut 314 may be used to lock and unlock the adjustment lock. The earphone may be translatable relative to the helmet while secured to the helmet by releasing an adjustment lock to permit translation of the earphone relative to the earphone connector portion of the connector.

The adjustment assembly may include a number of discrete set points, for example through the provision of ridges on a surface of the earphone. A plate attached to the nut 314 may include corresponding ridges which engage with the ridges on the earphone. In other embodiments, two flat plates without ridges may engage, or other configurations may be provided in which continuous adjustability is permitted.

Other adjustability arrangements may be used. For example, in some embodiments, a horizontal adjustment assembly may be included to permit adjustment forwardly and backwardly within the helmet. Or an adjustment assembly may allow adjustment of the earphone toward or away from the wearer's ears. In some embodiments, no adjustment assemblies are included.

A schematic representation of an electric contact pad 318 is shown in FIG. 3. The pad may include a one or more electrical contacts in any suitable form. In some embodiments, the electrical contacts are spring-biased pins which engage with complementary conductive pads present on the helmet connector portion. The electrical contacts may transfer electric power from a helmet-mounted battery to the earphone in some embodiments. Data and sound, whether digital or analog, also may be transmitted via the electrical contacts.

Figure 4:
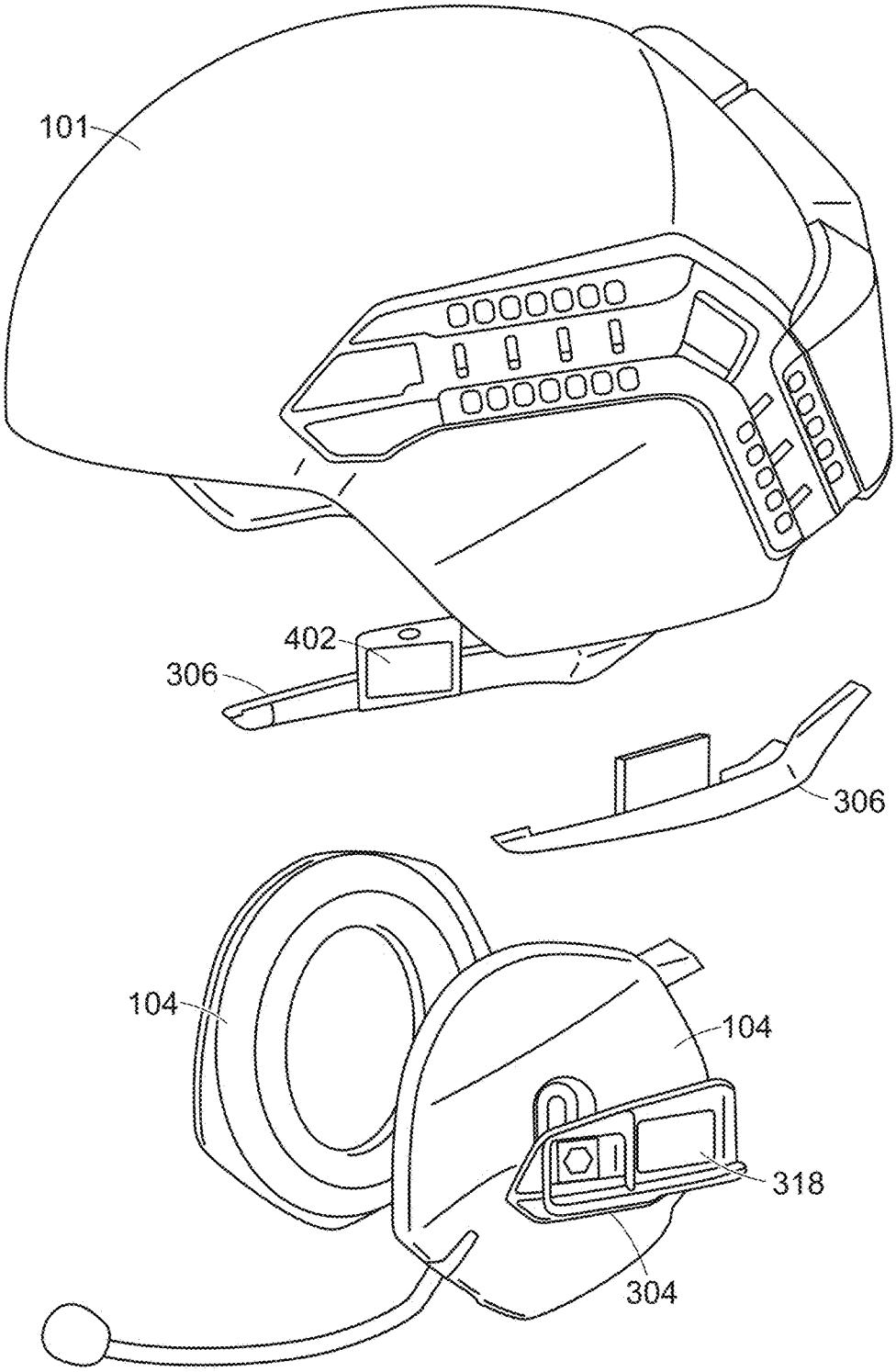
FIG. 4 is an exploded view of a helmet, helmet connector portion, and earphone assembly including an earphone connector portion.

A schematic representation of a corresponding helmet electric contact pad 402 is shown in FIG. 4. Another helmet electric contact pad may be present on the opposed helmet connector portion 306. The electric contact pads 402 are formed as part of the helmet connector portion assemblies, but may be separately attached to the helmet in some embodiments. The helmet connector portion are shown separated from the helmet in FIG. 4 for purposes of illustration, but the assemblies may be permanently attached to the helmet in some embodiments.

In some embodiments, the earphones do not electrically connect to the helmet. Instead, the earphone may be attached via cables to a radio or other communication or information device. In some embodiments, the physically attaching the earphones to the helmet does not result in an electrical connection. Instead, a separate electric connection may be made to the helmet, or to a device attached to the helmet, via electric wires which are attached separately from the physical attachment of the earphones to the helmet.

Figure 5:
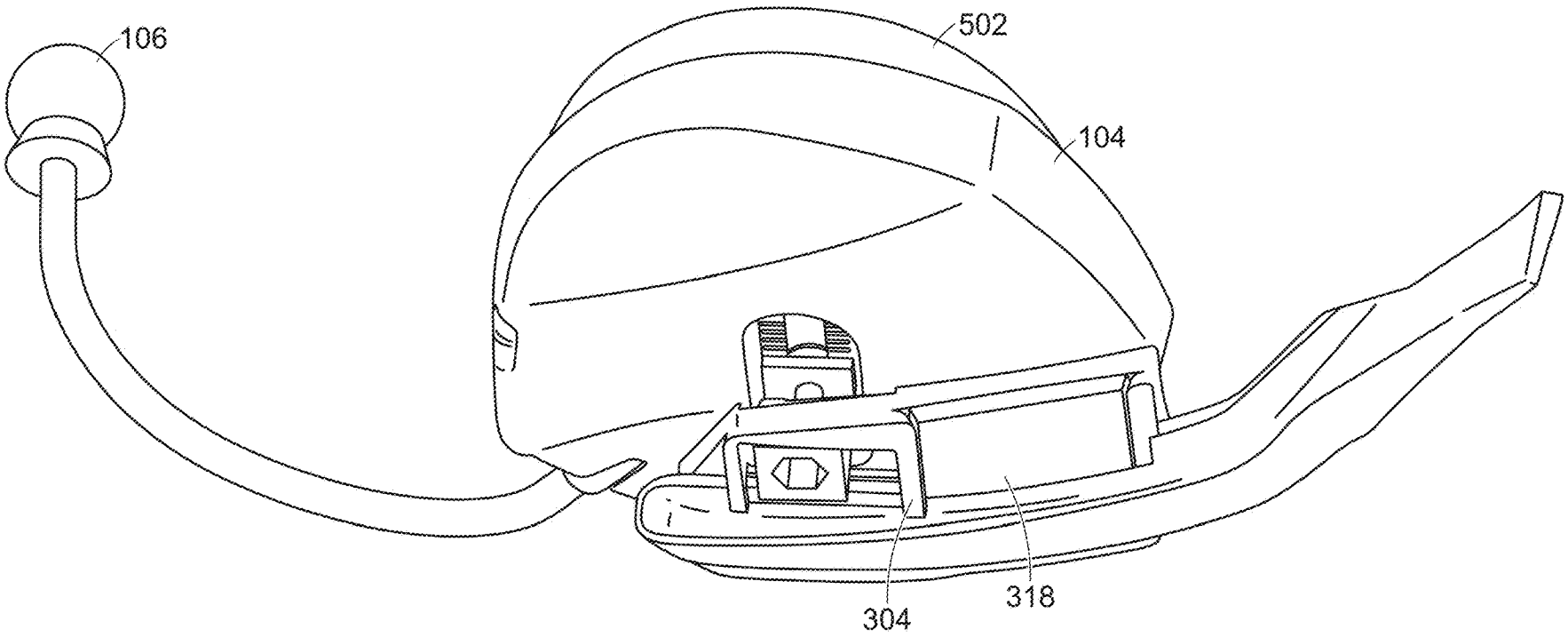
FIG. 5 is a top perspective view of an earphone and earphone connector portion.

FIG. 5 is a close-up view of earphone 104, earphone connector portion 304, and microphone 106. An ear cushion 502 surrounds the wearer's ear when the earphone is attached to the helmet and the helmet is worn. In some embodiments, no cushion may be present.

Further detail regarding the electrical connection and physical connection of the earphones to the helmet is shown in FIG. 6.

FIG. 6 shows an earphone 104 includes earphone connector portion 304. The earphone connector portion includes a recess 602 to receive a tab 604 located on helmet connection portion 106. Channel 308 slides over insert 307 slides until tab 604 snaps into recess 602. Note that in FIG. 6, earphone connector portion 304 and helmet connector portion 306 are shown with the tab 604 and recess 602 facing in the same direction. When engaging the two portions, one of the connector portions is flipped over so that the two portions can engage. Tab 604 is able to move outwardly when upper edge 608 of channel 308 passes over tab 604 because it is positioned on insert 307 which is cantilevered to helmet connector portion 106.

The component positions may be reversed in some embodiments such that tab 604 may be positioned earphone connector portion 304, with recess 602 positioned on helmet connector portion 306.

Electrical contact pad 318 on the earphone connector portion 304 may include one or more spring-biased pins 610 which are arranged to contact one more corresponding electric contact pads 612 located on electric pad 402 of the helmet connector portion 106. Other types of suitable electrical contacts may be used.

Figure 7:
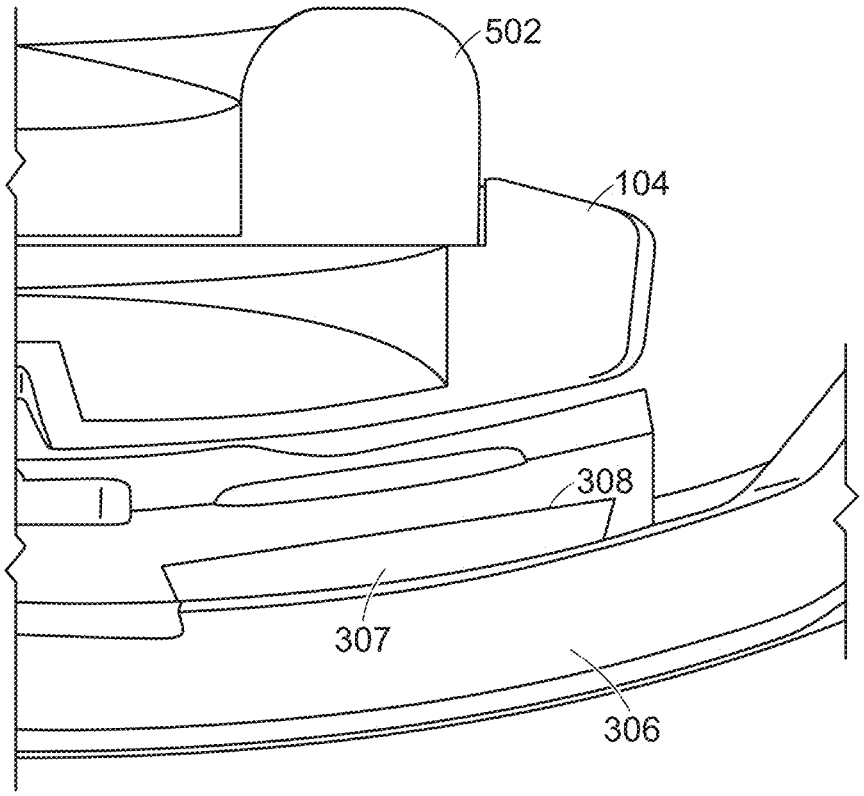
FIG. 7 is a cross-sectional view of a dovetail connection of an earphone connector portion to a helmet connector portion.

A cross-sectional view of one particular mechanical arrangement of the physical connection of the earphone connector portion to the helmet connector portion is shown in FIG. 7. Insert 307 and channel 308 form a dovetail arrangement such that removal of the insert 307 from the channel 308 in a direction transverse to their relative sliding motion is prevented. Other connection arrangements may be used in some embodiments, including inserts and recesses having different cross-sectional shapes than the shape illustrated in FIG. 7. Connection arrangements which do not include an insert and channel which slide relative to one another may be used in some embodiments.

Figure 8:
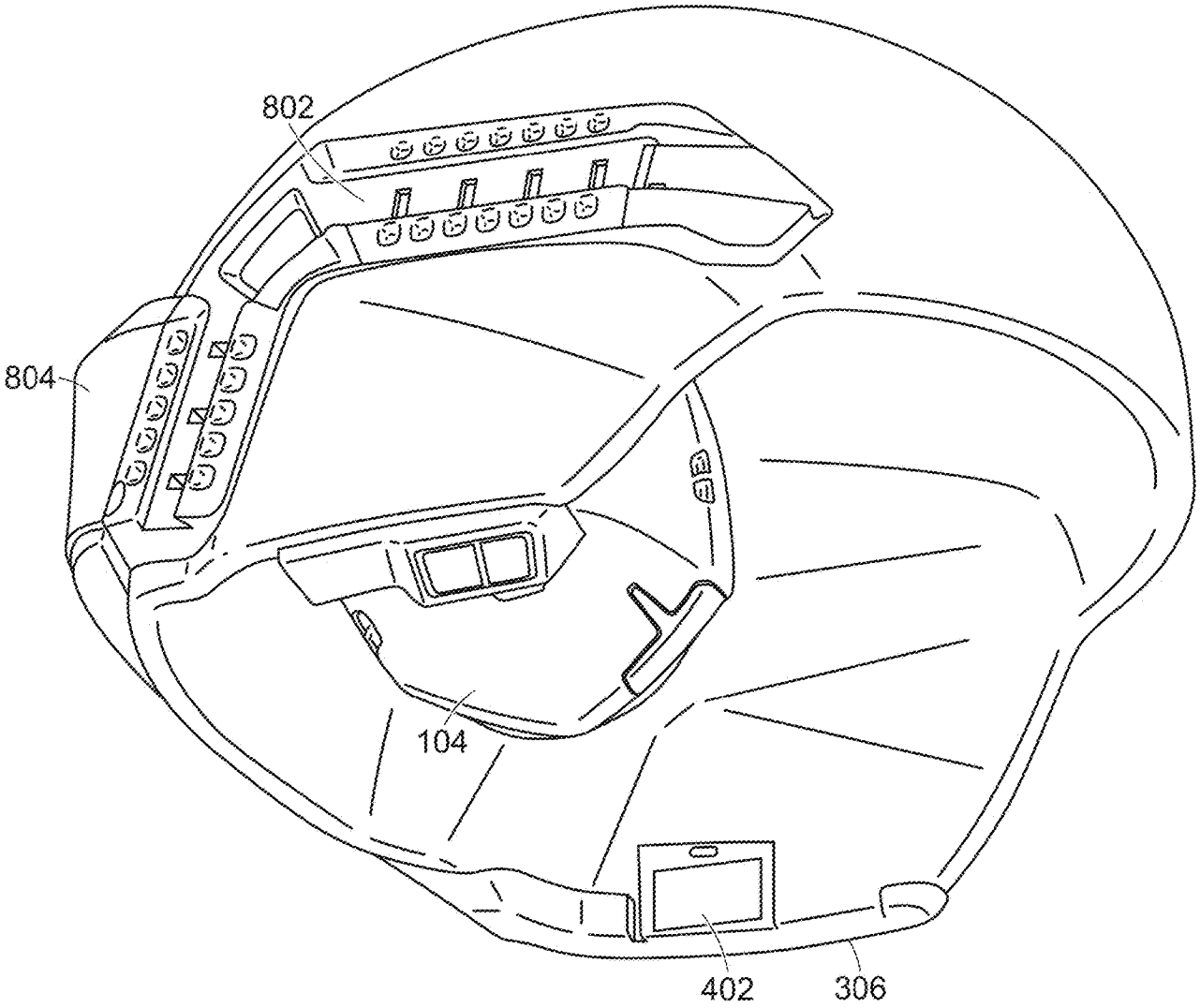
FIG. 8 is a bottom perspective view of a helmet including helmet connector portions.

Rails 802 or other assemblies for attaching helmet accessories to the exterior of the helmet may be present on the helmet in various embodiments, as shown in FIG. 8.

FIG. 8 also shows the wearer's left side of the helmet with the earphone removed, revealing the helmet connector portion 306, with its associated electric contact pad 402, attached to the helmet. The right side earphone 104 is attached to the helmet in FIG. 8.

A battery or other power source may be included on or within the helmet. In the embodiment shown in FIG. 8, a module 804 is attached to a rear of the helmet and includes battery. Other electronics or components may be included the rear module or elsewhere on the helmet. In some embodiments, a wireless transmitter and/or receiver is include on the helmet. In some embodiments, one or both of the earphones includes a wireless transmitter. The earphone connector portions may include a wireless transmitter and/or receiver.

Figure 9:
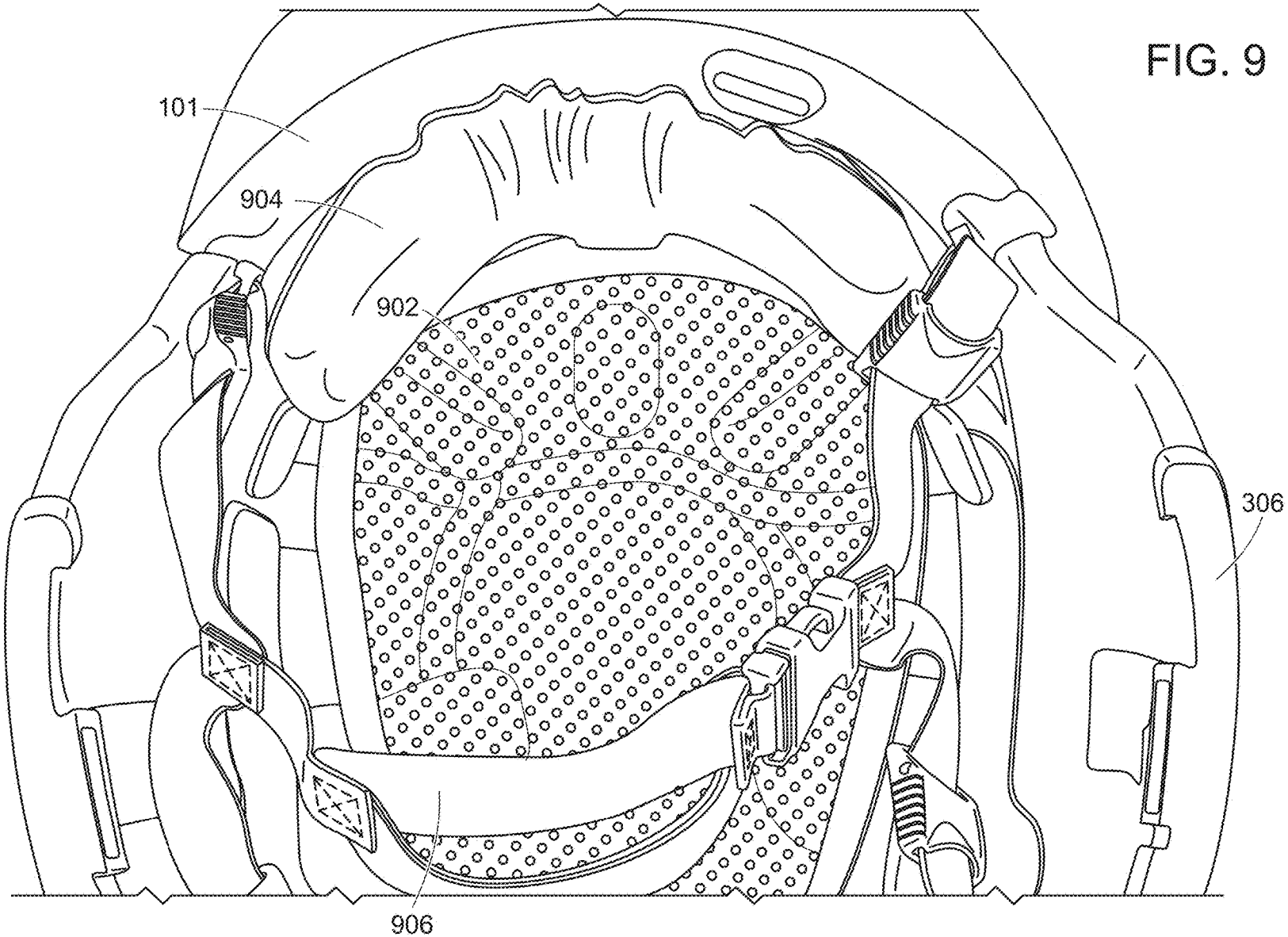
FIG. 9 shows a bottom view of a helmet with helmet connector portions, and a helmet suspension and strap assembly.

Helmet 101 is shown outfitted with a suspension system in FIG. 9. The suspension system includes a mesh 902 which rests on a wearer's head. Internal padding 904 is attached to the inside of the helmet. A strap assembly 906 is attached to the mesh 902 and may include adjustable straps to secure the helmet to the wearer.

Figure 10:
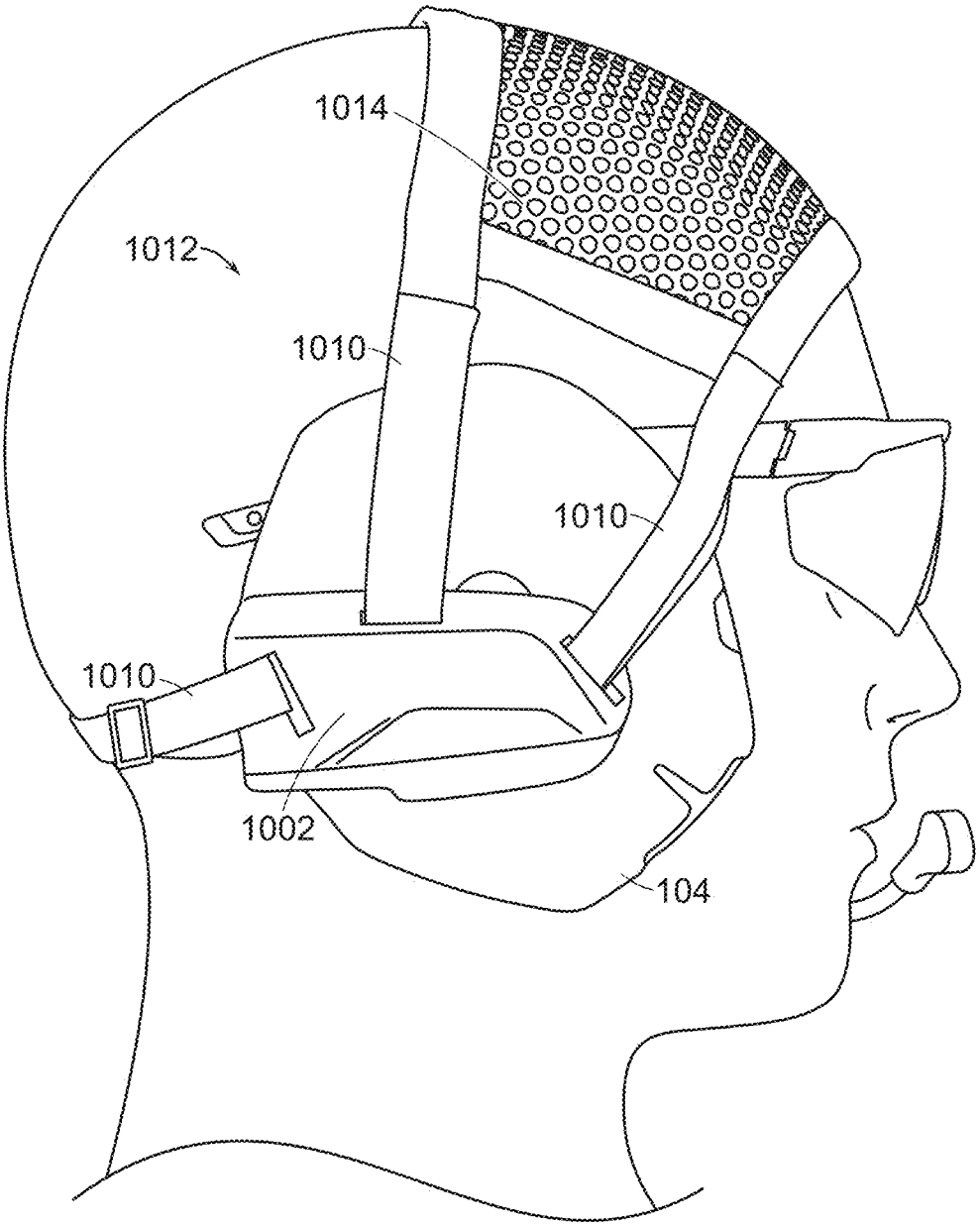
FIG. 10 shows an earphone attached to a strap holder adapter, and a strap assembly to support earphones on a wearer's head without the use of a helmet.
Figure 11:
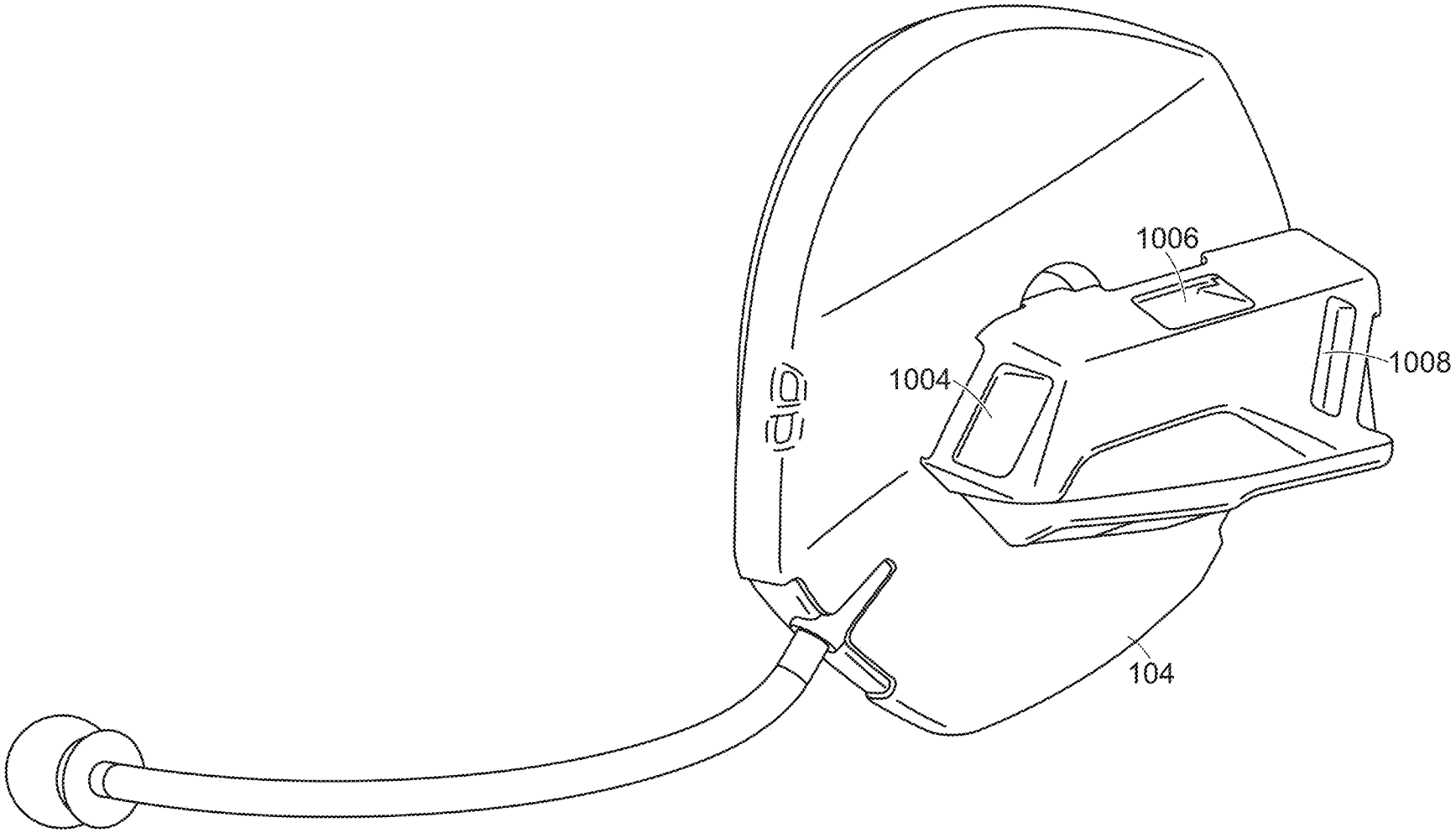
FIG. 11 is a perspective view of an earphone attached to a strap holder adapter.

A wearer may wish to use headphones both with and without a helmet. A strap holder adapter 1002 is shown in FIGS. 10 and 11, and provides a method of using headphones 104 without helmet 100. Strap holder adapter 1002 includes a connector portion that is similar to the helmet connector portion 306 shown in FIG. 6. As such, earphone 104 can be attached strap holder adapter 1002 in a manner similar to how the earphone is attached to the helmet. That is, recess 308 of earphone 104 can be slid relative to insert 307 on the strap holder adapter 1002, and a snap-fit arrangement can lock the earphone into place relative to the strap holder adapter. Other connector arrangements may be used, and in some embodiments, a first connector arrangement may be used to attach the earphone to the helmet, and a second, different connector arrangement may be used to attach the earphone to the strap adapter.

Strap holder adapter 1002 includes openings 1004, 1006, and 1008 through which straps 1010 of a strap assembly 1012 are passed. Strap assembly 1012 includes a mesh 1014 to support the overall assembly on the wearer's head.

Strap holder 1002 may include a battery and a wireless transmitter and/or receiver. Further electronic components, including a microprocessor, may be included.

For purposes herein, the terms "connect", "connected", "connection", "couple", "coupled", "attach", "attached" and "attachment" refer to: direct connections, couplings, and attachments; indirect connections, couplings, and attachments; and operative connections, couplings, and attachments. Also for purposes herein, the terms "connectable", "attachable", "removable", etc. refer both to components which can be connected, attached, removed, etc., and also refer to components which are connected, attached and removed.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A helmet and earphone assembly, comprising:

a helmet shell including a first helmet electrical contact, and having a front, a rear, two sides, and a face opening at the front of the shell, the helmet shell including an interior surface, an exterior surface, and a rim extending between the interior surface and the exterior surface wherein the rim extends along each side of the two sides of the helmet shell, and wherein the first helmet electrical contact is positioned on the interior surface on one of the two sides; and an earphone including a first earphone electrical contact, the earphone being removably securable to the helmet via a connector such that translation of the earphone relative to the helmet is prevented when the earphone is secured to the helmet via the connector, wherein when the earphone is connected to the helmet and the helmet is worn by a wearer, the assembly is configured to have the earphone positioned between the wearer's head and the helmet shell;

wherein the connector, the first helmet electrical contact, and the first earphone electrical contact are arranged such that securement of the earphone to the helmet via the connector brings the first earphone support electrical contact into contact with the first helmet electrical contact.

2. An assembly as in claim 1, wherein when the first earphone electrical contact is in contact with the first helmet electrical contact, the earphone is electrically connected to a power source.

3. A helmet and earphone assembly as in claim 1, wherein the connector is arranged such that rotation of the earphone relative to the helmet is prevented when the earphone is secured to the helmet via the connector.

4. A helmet and earphone assembly as in claim 1, wherein the connector comprises a snap-fit connector.

5. A helmet and earphone assembly as in claim 4, wherein the connector comprises a cantilever snap-fit connector.

6. A helmet and earphone assembly, comprising:

a helmet including a first helmet electrical contact and a helmet shell, the helmet shell having a front, a rear, two sides, and a face opening at the front of the shell, the helmet shell including an interior surface, an exterior surface, and a rim extending between the interior surface and the exterior surface wherein the rim extends along each side of the two sides of the helmet shell, and wherein the first helmet electrical contact is positioned on the interior surface of the helmet shell; and an earphone including a first earphone electrical contact and an adjustment lock, the earphone being removably securable to the helmet via a connector, wherein the earphone is stationary relative to the helmet when the adjustment lock is locked, and translatable relative to the helmet when the adjustment lock is unlocked, wherein when the earphone is connected to the helmet and the helmet is worn by a wearer, the assembly is configured to have the earphone positioned between the wearer's head and the helmet shell;

wherein the connector, the first helmet electrical contact, and the first earphone electrical contact are arranged such that securement of the earphone to the helmet via the connector brings the first earphone support electrical contact into contact with the first helmet electrical contact.

7. The helmet and earphone assembly of claim 6, wherein the rim extends continuously around an entire perimeter of the helmet shell.

8. A helmet and earphone assembly, comprising:

a helmet shell having a front, a rear, two sides, and a face opening at the front of the shell, the helmet shell including an interior surface, an exterior surface, and a rim extending between the interior surface and the exterior surface, and extending along each side of the two sides of the helmet shell; and a first helmet electrical contact, wherein the first helmet electrical contact is positioned on the interior surface of the helmet shell; and an earphone including a first earphone electrical contact, the earphone being removably securable to the helmet via a connector such that translation of the earphone relative to the helmet is prevented when the earphone is secured to the helmet via the connector, wherein when the earphone is connected to the helmet, the earphone is positioned at least partially within the helmet shell and is adjacent to the interior surface of the helmet shell;

wherein the connector, the first helmet electrical contact, and the first earphone electrical contact are arranged such that securement of the earphone to the helmet via the connector brings the first earphone support electrical contact into contact with the first helmet electrical contact.

9. An assembly as in claim 8, wherein when the first earphone electrical contact is in contact with the first helmet electrical contact, the earphone is electrically connected to a power source.

10. A helmet and earphone assembly as in claim 8, wherein the connector is arranged such that rotation of the earphone relative to the helmet is prevented when the earphone is secured to the helmet via the connector.

11. A helmet and earphone assembly as in claim 8, wherein the connector comprises a snap-fit connector.

12. A helmet and earphone assembly as in claim 11, wherein the connector comprises a cantilever snap-fit connector.

13. The helmet and earphone assembly of claim 8, wherein the helmet shell further includes a second helmet electrical contact, wherein the second helmet electrical contact is positioned on an opposing portion of the interior surface relative to the first helmet electrical contact, the helmet and earphone assembly further comprising:

a second earphone including a second earphone electrical contact, the second earphone being removably securable to the helmet via a second connector such that translation of the second earphone relative to the helmet is prevented when the second earphone is secured to the helmet via the second connector, wherein when the second earphone is connected to the helmet, the second earphone is positioned at least partially within the helmet shell and is adjacent to the interior surface of the helmet shell;

wherein the second connector, the second helmet electrical contact, and the second earphone electrical contact are arranged such that securement of the second earphone to the helmet via the second connector brings the second earphone electrical contact into contact with the second helmet electrical contact.

14. The helmet and earphone assembly of claim 8, wherein the rim extends continuously around an entire perimeter of the helmet shell.

* * * * *